United States Patent [19]

Cheh et al.

[11] 4,439,919

[45] Apr. 3, 1984

[54] AUTOMATIC LEAD MAKING APPARATUS

[75] Inventors: Ernest Cheh, W. Norwalk; William Allen, Stratford, both of Conn.

[73] Assignee: Burndy Corporation, Norwalk, Conn.

[21] Appl. No.: 207,046

[22] Filed: Nov. 14, 1980

[51] Int. Cl.[3] ..... H01R 43/04

[52] U.S. Cl. ..... 29/861; 29/749; 29/748; 29/564

[58] Field of Search ..... 29/748, 749, 857, 866, 29/564.4

[56] References Cited

U.S. PATENT DOCUMENTS

| | | | |
|---|---|---|---|
| 3,866,295 | 2/1975 | Tucci | 29/749 X |
| 4,043,017 | 8/1977 | Folk et al. | 29/749 |
| 4,126,935 | 11/1978 | Rhines et al. | 29/749 X |
| 4,136,440 | 1/1980 | Brandewie et al. | 29/749 X |
| 4,281,442 | 8/1981 | Senior et al. | 29/749 X |

*Primary Examiner*—Mark Rosenbaum

*Assistant Examiner*—Carl J. Arbes

*Attorney, Agent, or Firm*—Howard S. Reiter

[57] ABSTRACT

An apparatus that withdraws a predetermined length of electrical wire from a supply, cuts the predetermined length and places an electrical connector on at least one end of the length of wire is disclosed. The apparatus includes a movably mounted guide that positions wire from a supply of wire to a work location; a cutter for cutting a predetermined length of wire as the wire is supported by a gripper device; a movable carriage that holds a connector and brings the connector into position for attachment to the wire, and at the same time the movable guide is displaced away from the path of the movable carriage to permit the carriage to bring the connector into position for attachment to a wire as it is supported by the gripper device; and a releasing mechanism for separating a cut and predetermined length of wire from the gripping device.

11 Claims, 11 Drawing Figures

AUTOMATIC LEAD MAKING APPARATUS

BACKGROUND OF THE DISCLOSURE

I. Field of the Invention

The present invention relates generally to an apparatus for use in the manufacture of an electrical lead, and more particularly, to an apparatus that severs a predetermined length of wire from a supply and installs an electrical connector on at least one end of the length of wire, both operations occurring at the same work location in the apparatus.

II. Description of the Prior Art

It is a conventional practice in the electrical wire lead manufacturing industry to secure electrical connectors to lengths of wire. In fact, many different kinds of machines have been employed for this purpose. Generally, in known machines the desired length of wire is first pulled horizontally, cut and then supported at both ends in the machine. Thereafter, at separately spaced apart work locations, electrical connectors are secured to each end of the length of wire. Several problems arise with this type of system. First, when the electrical wire is pulled horizontally to the desired length, it must be supported at both ends to be able to secure the connectors thereto. The problem arises in this connection when long lengths of wire are required. Obviously, the length of wire is somewhat restricted by the length of the machine. To overcome this problem and allow for longer wire lengths, in many manufacturing processes, the mid-section of the length of wire has been pushed away from the machine by, for example, a cam device. However, this operation tends to bend the wire and distort it. Thus, the machine generally requires an additional device and process step which straightens the bent wire. Second, the efficiency of a machine of this type is certainly lowered when there are spaced apart work locations since this requires the operator to constantly move from one work location to the other. Third, an additional problem arises when it is desired to manufacture an electrical lead formed of a plurality of wires fed horizontally at the same time in that there is a constant problem in keeping the wires separate and in alignment. This problem becomes particularly acute when it is desired to manufacture long electrical leads.

SUMMARY OF THE INVENTION

It is therefore an object of the present invention to overcome many of the disadvantages of the wire lead making machines as described above, and to provide a novel apparatus for use in the manufacture of electrical wire leads which allows for a considerable increase in production efficiency and which provides significant practical advantages over known machines and techniques.

It is a further object of this invention to provide an apparatus for manufacturing electrical wire leads which cuts a predetermined length of wire from a wire supply and installs an electrical connector on at least one end of the length of wire, both operations occurring at the same work location.

It is another object of this invention to provide an apparatus that can form electrical wire leads of indefinite lengths without bending or distorting the wire.

It is yet another object of this invention to provide an apparatus that can manufacture electrical wire leads formed of a plurality of spaced apart wires and keep the wires properly aligned during the manufacturing operations.

It is still a further object of this invention to provide an apparatus for manufacturing electrical wire leads which can be fully automated.

The foregoing objects and others are accomplished in accordance with the present invention by providing a machine for withdrawing a pre-determined length of electrical wire from a supply, severing said pre-determined length from said supply, and installing an electrical connector on at least one end of said length the machine comprising: feed means for advancing a predetermined length of wire axially in a given direction; guide means having an entry for receiving wire from the feed means, and an exit for positioning wire at a work location; gripper means spaced from the exit of the guide means along the given direction of motion of a wire, for gripping a portion of wire which has exited from the guide means; cutter means movable along a path transverse to the given direction of motion of a wire intermediate the exit of the guide means and the gripper means for severing a wire which has exited from the guide means; connector carrying means movable along a path transverse to the given direction of motion of a wire, the path being positioned intermediate the exit of the guide means and the gripper means, for advancing a connector into position for an attachment to a wire which has exited from the guide means; the guide means being movable mounted relative the path of the connector carrying means so that the exit of the guide means may be selectively displaced away from the path of the connector carrying means to permit carrying a connector into position for attachment to a wire gripped in the gripper means; and release means for separating a severed, pre-determined length of wire from the gripper means.

BRIEF DESCRIPTION OF THE DRAWINGS

For a better understanding of the invention as well as other objects and further features thereof, reference is made to the following detailed disclosure of this invention taken in conjunction with the accompanying drawings wherein.

DESCRIPTION OF THE PREFERRED EMBODIMENTS

Figure 1:
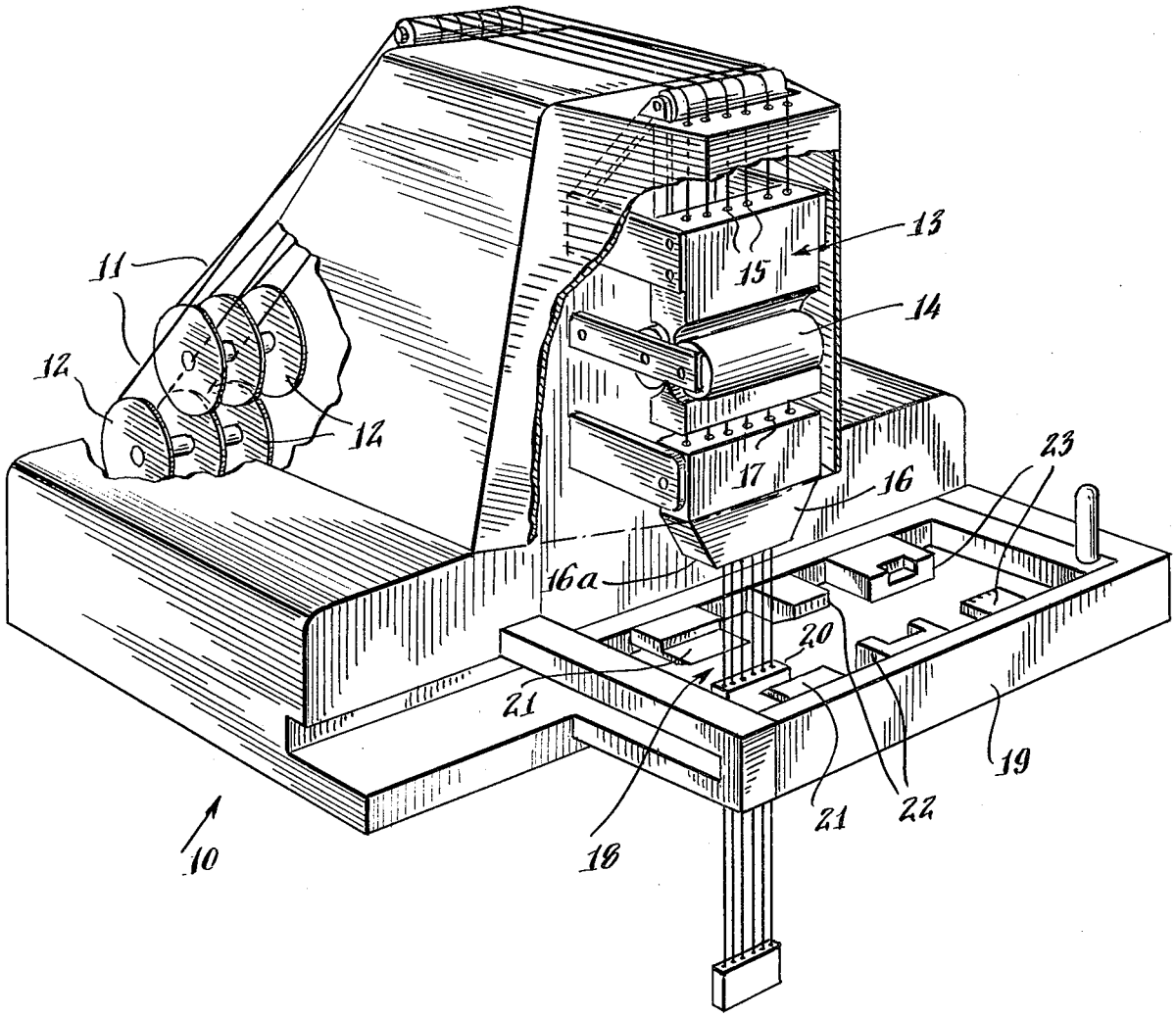
FIG. 1 is a fragmentary perspective view of an apparatus for manufacturing electrical wire leads in accordance with the preferred features of the present invention.

Referring now to the drawings and particularly to FIG. 1 thereof, there is shown an embodiment of an electric wire lead making machine 10 in accordance with the features of the present invention. As illustrated wires 11 are fed to the machine from a plurality of wire supply reels 12. Although the drawings illustrate a machine that manufactures electrical wire leads from a plurality of wires, i.e. six wires, it is to be understood that it is within the scope of the present invention that lead making machine 10 can manufacture electric wire leads that are formed (a) of only one wire, (b) of a plurality of wires (two, three, four, etc.) as illustrated in the drawings, or (c) of ribbon cable that, like a single wire, can be fed to the machine from only one supply reel. If ribbon cable is used, it would be apparent to one skilled in the art the type of minor modifications that can be made to machine 10 to process this kind of cable into electric leads, e.g. a cutting mechanism would be required to blank out a portion of the web between the conductors in the cable. Wires 11 are fed to a wire guide 13 that includes a pair of wire feed rollers 14 which are actuated by a controller for feeding a pre-set specific length of wire down through the machine. Guide 13 includes a series of spaced apart openings 15 for receiving wires 11 from wire supply reels 12, and for exiting and positioning the wires to pivotable wire guide 16. The pivotable wire guide includes a plurality of spaced apart openings 17 which provide a means for an entry for receiving wire, and an exit for positioning the wire at an area that will be referred to as the work location 18. Pivotable wire guide 16 is movably mounted relative to the path of an electrical connector carrying means in the form of movable carriage assembly 19 so that exit portion 16*a* of guide 16 can be selectively displaced away from the path of the movable carriage assembly to permit assembly 19 to carry a connector into position in work location 18 and attach a connector to wires 11 as the wires are secured in wire gripper 20. Located directly beneath pivotable wire guide 16 is work location 18 where various operations are performed, and the electric wire lead is manufactured. Located directly below work location 18 along the direction of motion of wires 11 and spaced from pivotable wire guide 16, is a gripper 20 for gripping a portion of wires 11 which have exited from guide 16. The gripper is preferably in the form of a split wire guide formed of a plurality of finger-like elements (not shown) which (a) completely open to release a severed and finished electrical wire lead from the machine, (b) partially close to form a plurality of openings betwen the finger-like elements for the purpose of keeping wires 11 straight and preventing the wires from crossing over each other as the wires are guided down through the machine, and (c) completely close to hold wires 11 in position as they are cut to a predetermined length. Traversing the downward path of wires 11, intermediate the exit portion 16*a* of pivotable wire guide 16 and gripper 20, is a motor-driven movable (slidable) carriage assembly 19. The carriage assembly includes as a part thereof the various assembly tools necessary for manufacturing the electric wire leads, and transports each of these tools to work location 18 at the proper sequence during operation of machine 10 in a manner as explained in greater detail hereinbelow. As shown in the embodiment illustrated in FIG. 1 carriage assembly 19 includes a pair of cutting blades 21 for severing wires 11 which have exited from wire guide 16, and two assembly tools 22 and 23. One of the assembly tools 23 is for securing a connector to the leading end of wires 11 and the other tool 22 is for securing a connector to the trailing end of a determined length of wires 11. Although in the specific embodiment illustrated in FIG. 1, the cutting blades 21 travel with carriage assembly 19 so they are moved laterally away from work location 18 when another process is performed by machine 10, it is within the scope of the present invention that the cutting blades be mechanically secured to the frame of machine 10 and be withdrawn from the work location after cutting wires 11 by a means other than the movable carriage assembly 19.

Figure 2:
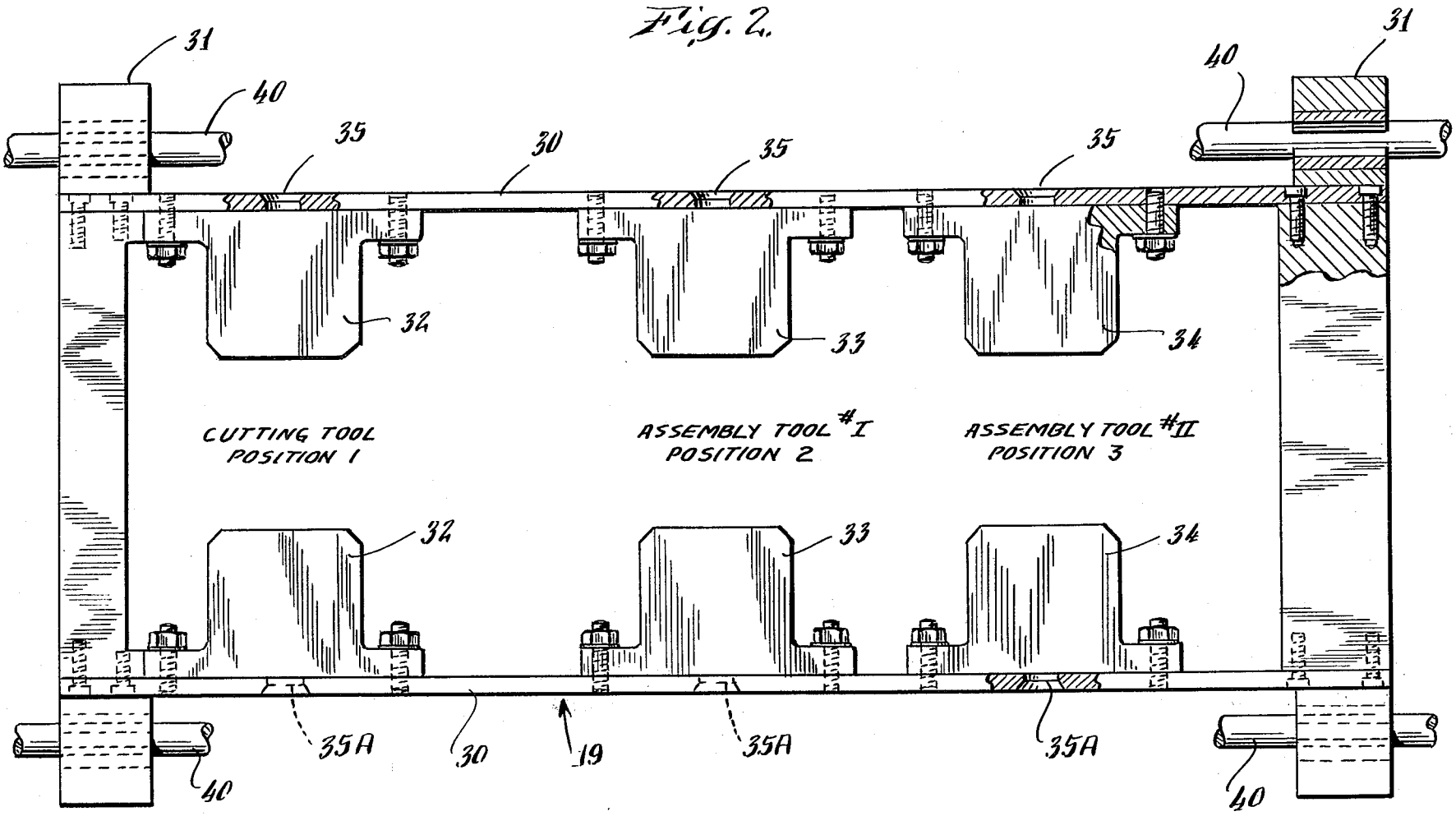
FIG. 2 is a partial top plan view of a movable carriage assembly for use in the apparatus of the present invention.
Figure 3:
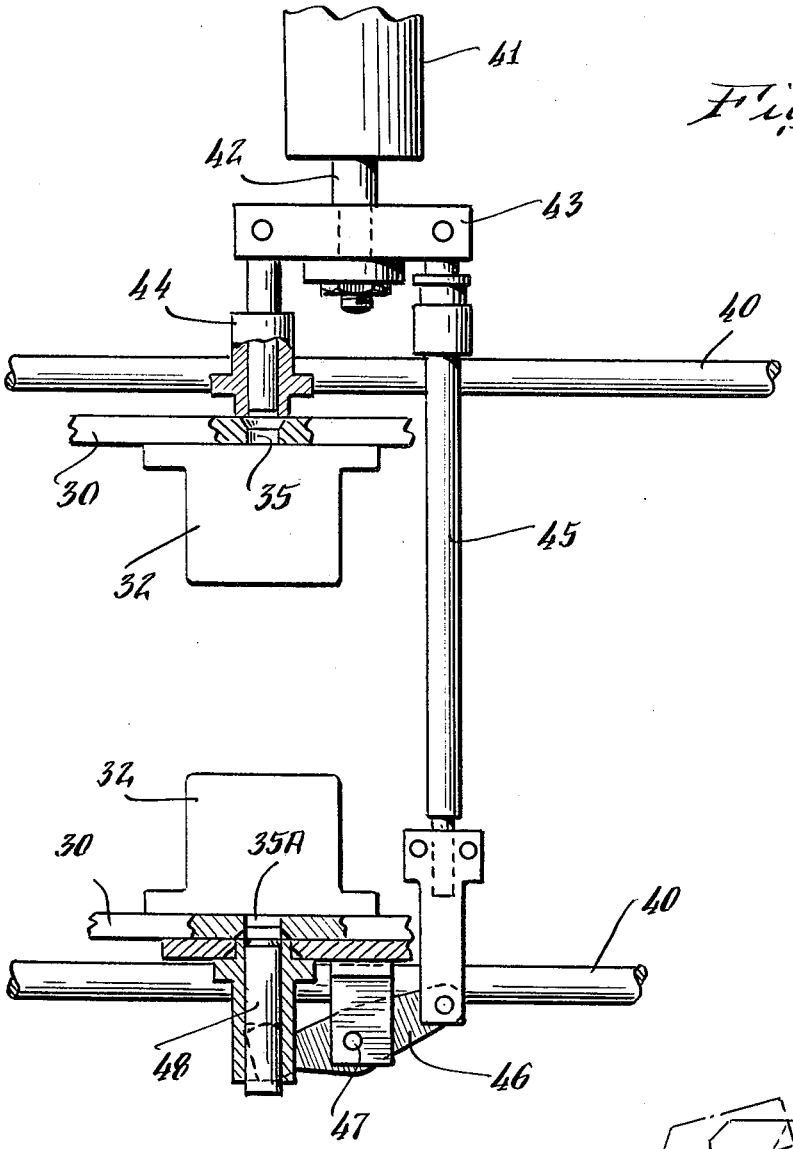
FIG. 3 is a top plan view of a mechanism for driving the tooling positioned on the carriage assembly illustrated in FIG. 2.

In FIG. 2 and FIG. 3 there is shown in more detail an embodiment of a movable carriage assembly in accordance with the present invention. As shown in FIG. 2 carriage assembly 19 includes a frame member 30 to which is secured bearing supports 31 which allow carriage assembly 19 to be slidably mounted on two substantially parallel rails 40 (see FIG. 3) mounted within the machine frame. Secured to frame member 30 is a cutting tool 32, in a first position on the carriage assembly, preferably in the form of a pair of cutting blades 21 (FIG. 1), a first assembly tool 33 in the second position for securing an electrical connector to the trailing end of an electrical lead, and a second assembly tool 34 in the third position on the carriage assembly for securing an electrical connector to the leading end of the electrical lead. Although the specific embodiment of the present invention that is described herein illustrates an electrical lead making apparatus having a movable carriage assembly 19 with three tools thereon for performing certain operations in manufacturing a completed electrical lead, it is to be understood that it is within the scope of the present invention that the carriage assembly be used for supporting other tools that could perform other types of operations on the electrical leads. Located on frame member 30, and properly aligned with cutting tool 32 and assembly tools 33 and 34, are a plurality of openings 35 and 35A which permit driving pins to be inserted therein and activate each of these tools in the manner as more fully described hereinbelow.

FIG. 3 shows the means by which each of cutting tool 32 and assembly tools 33 and 34 operate. Specifically, the mechanism for operating these three tools include a power air cylinder 41 that is activated by an electrical air valve (not shown) which is controlled by a switch (not shown) that in turn can be activated by an operator or automatically. Secured to, and operated by power air cylinder 41 is an air cylinder piston rod 42 that is connected to a bar element 43. Bar element 43 is connected at one end thereof to driving pin 44 which moves in an inward direction through any of openings 35 on frame 30 to thereby activate one part of either cutting tool 32 or assembly tools 33 or 34. The opposite end of bar element 43 is secured to one end of push rod 45 that is in turn secured to a pivoting linkage 46 that pivots about pin 47. Pivoting linkage 46 has connected to it a second driving pin 48 which moves in an inward direction through any of openings 35A at the same time driving pin 44 moves in through any of the corresponding openings 35 to thereby simultaneously operate the second part of the cutting tool or either of the assembly tools.

Figure 5:
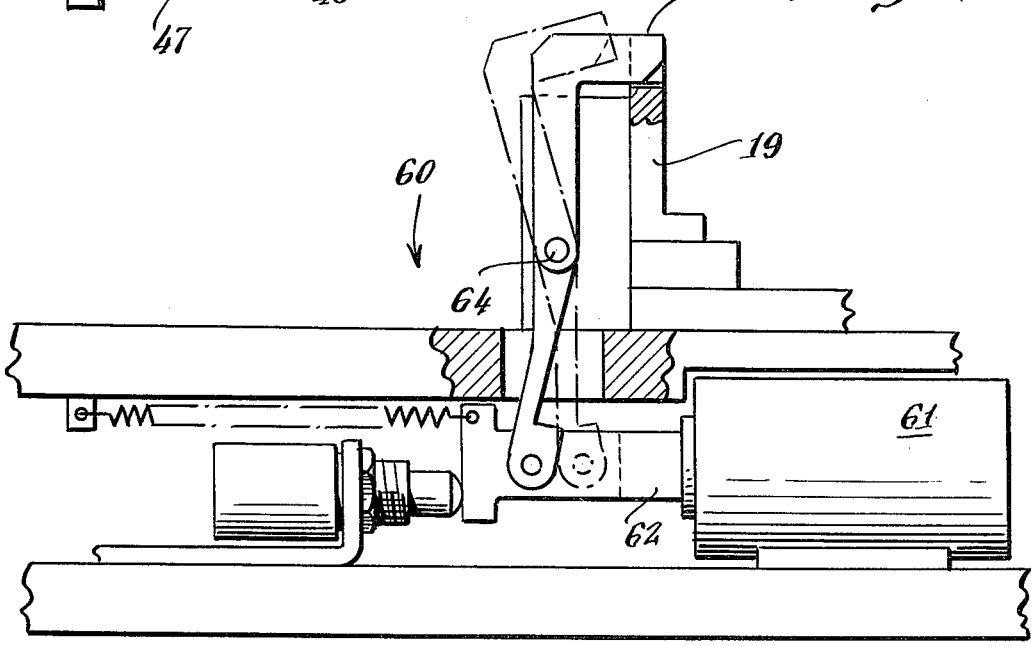
FIG. 5 is a side plan view of an embodiment of a locking mechanism for locking the carriage assembly illustrated in FIG. 2, in place.
Figure 4B:
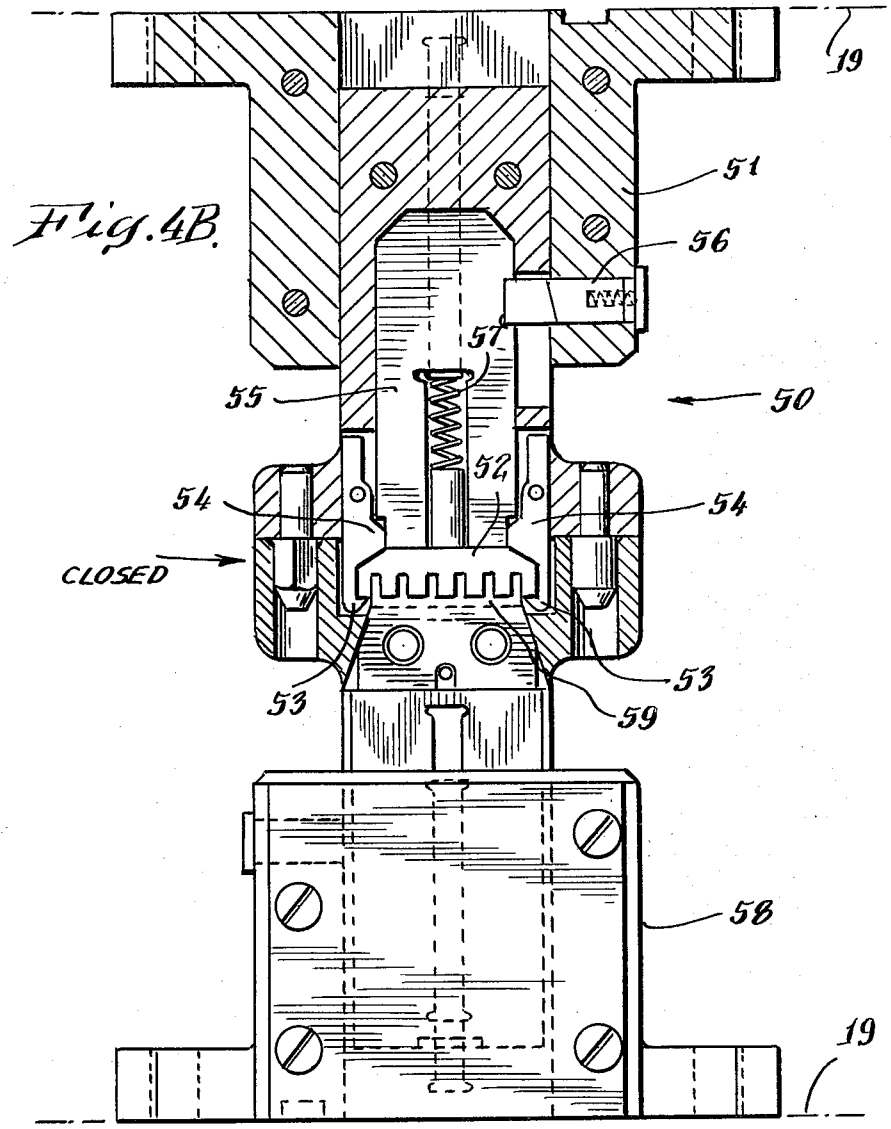
FIGS. 4A and 4B are top plan views, partly in section of an assembly tool used for securing an electrical connector to a wire, in open and closed positions.
Figure 4A:
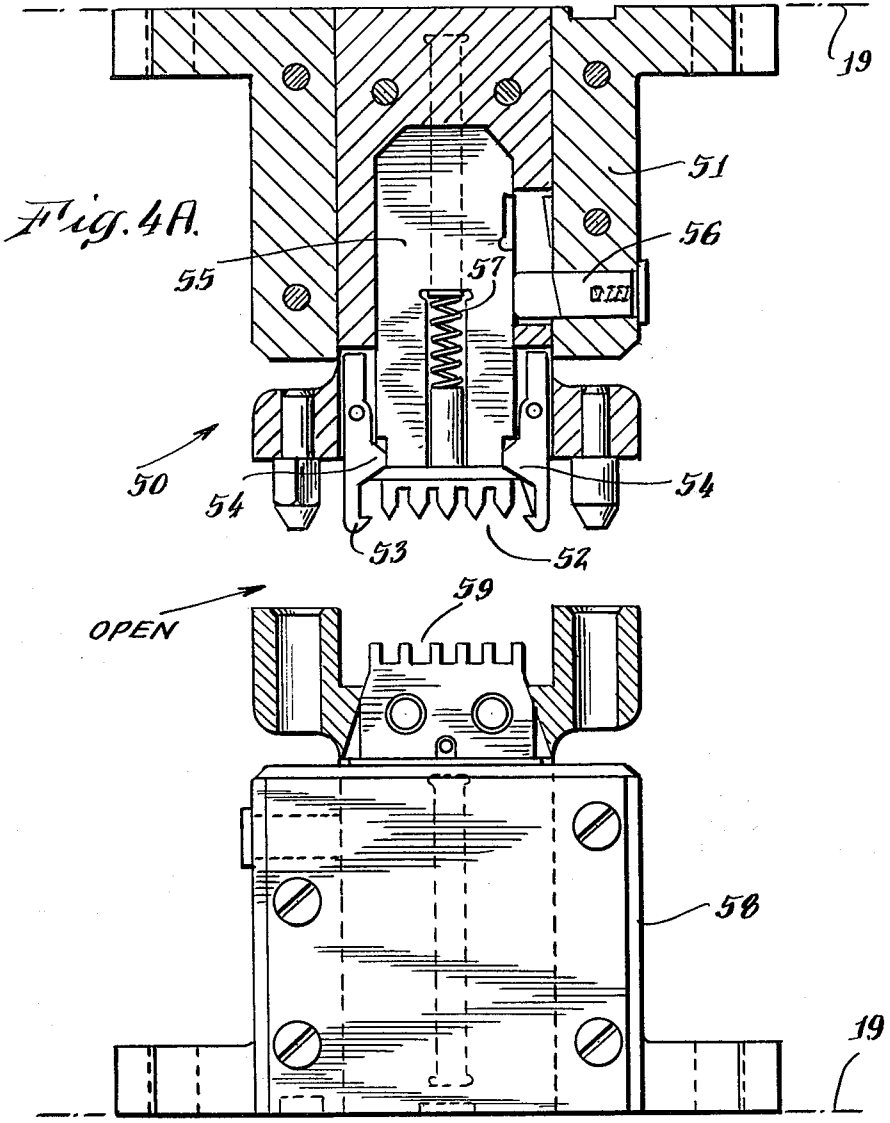
Figure 6A:
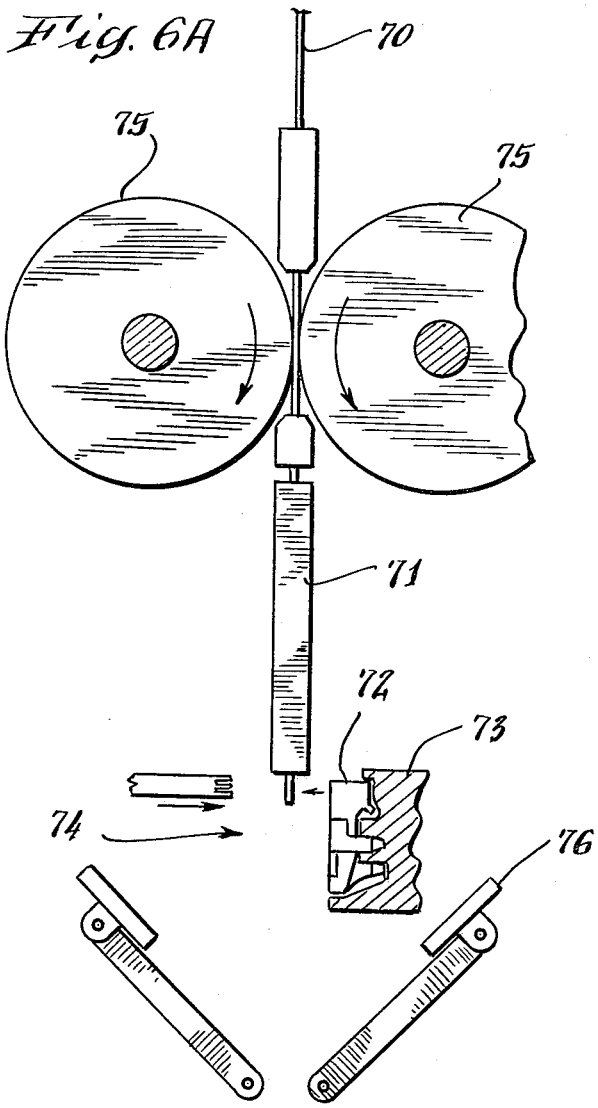
FIGS. 6A, 6B, 6C, 6D, and 6E are schematic views of an apparatus for manufacturing electrical wire leads in accordance with the preferred features of the present invention illustrating the primary process steps involved during the operation of the apparatus.
Figure 6B:
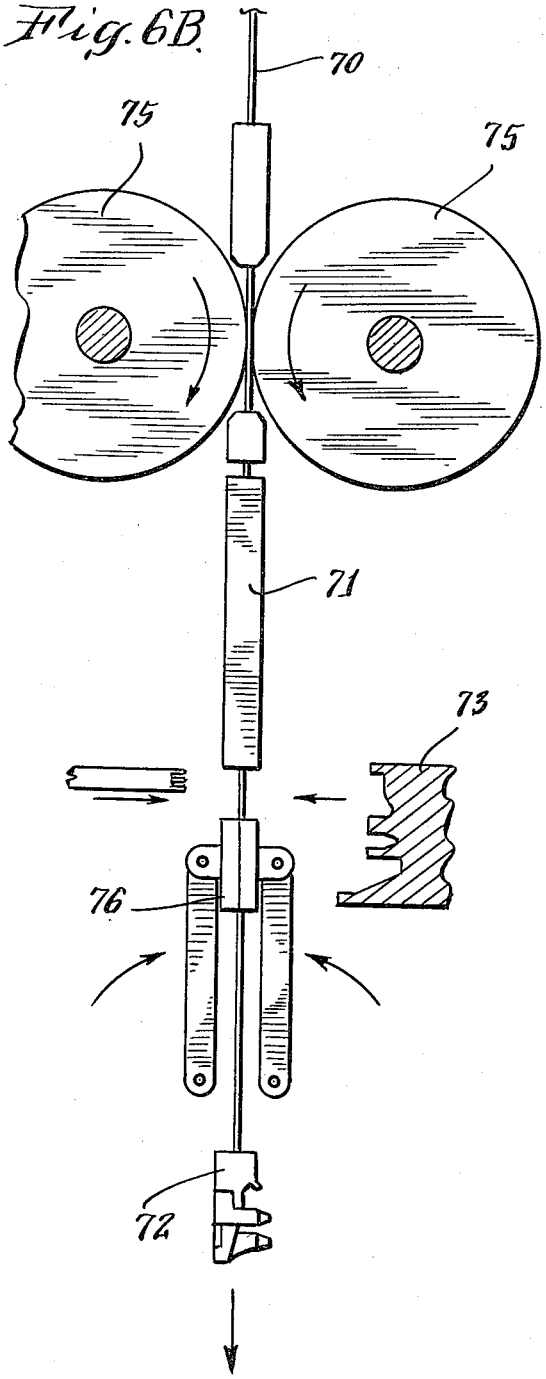
Figure 6C:
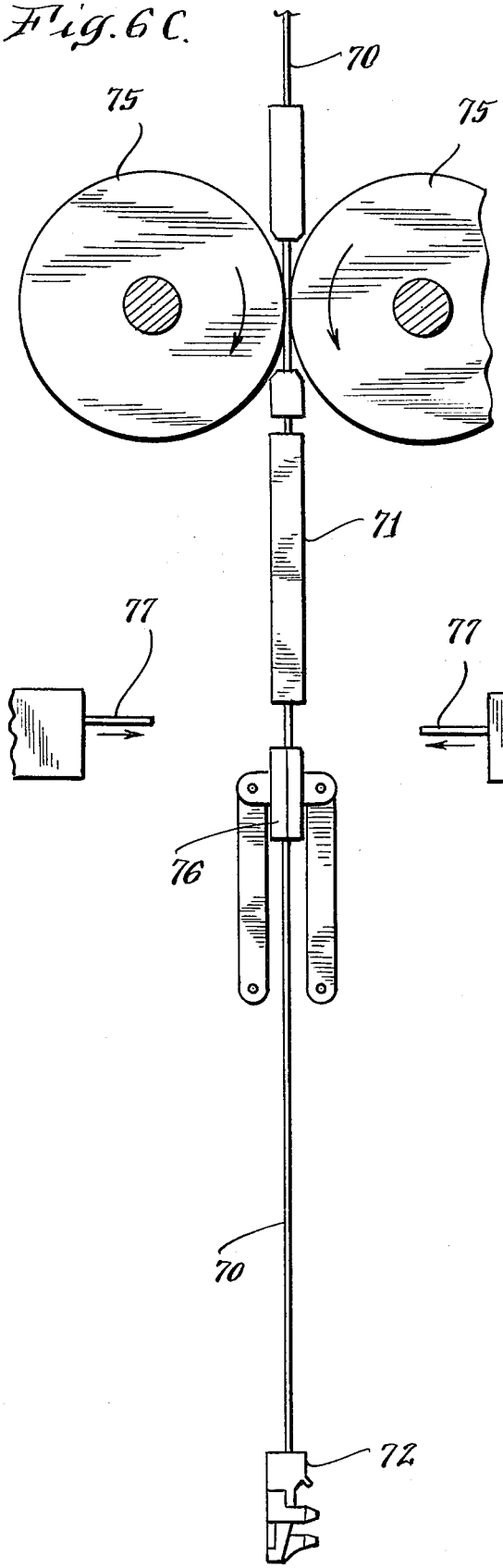
Figure 6D:
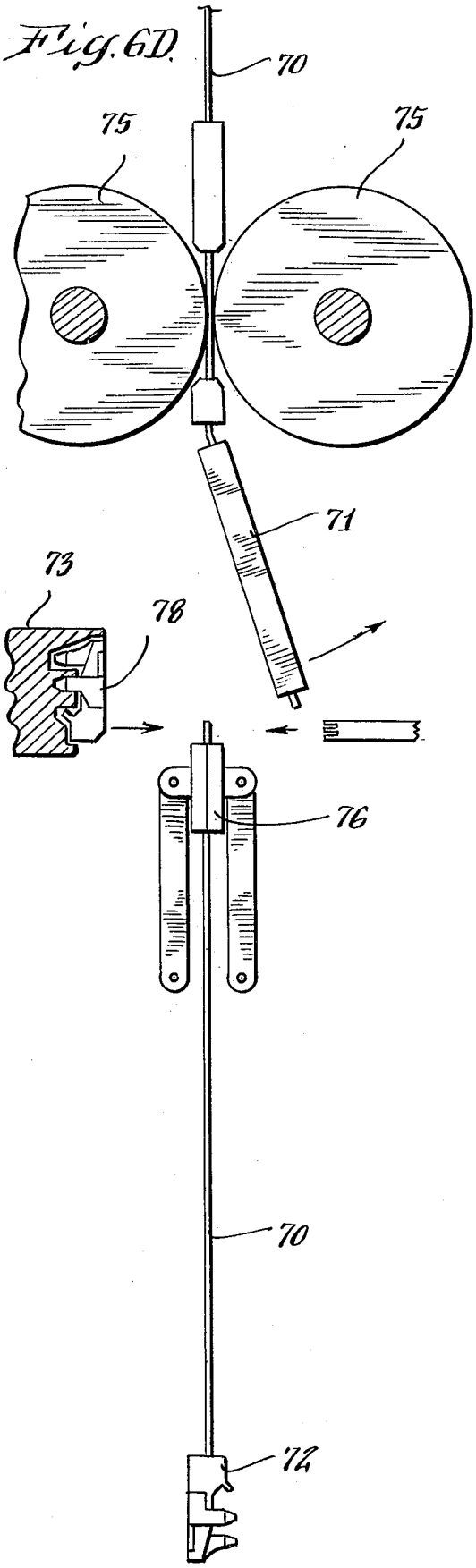
Figure 6E:
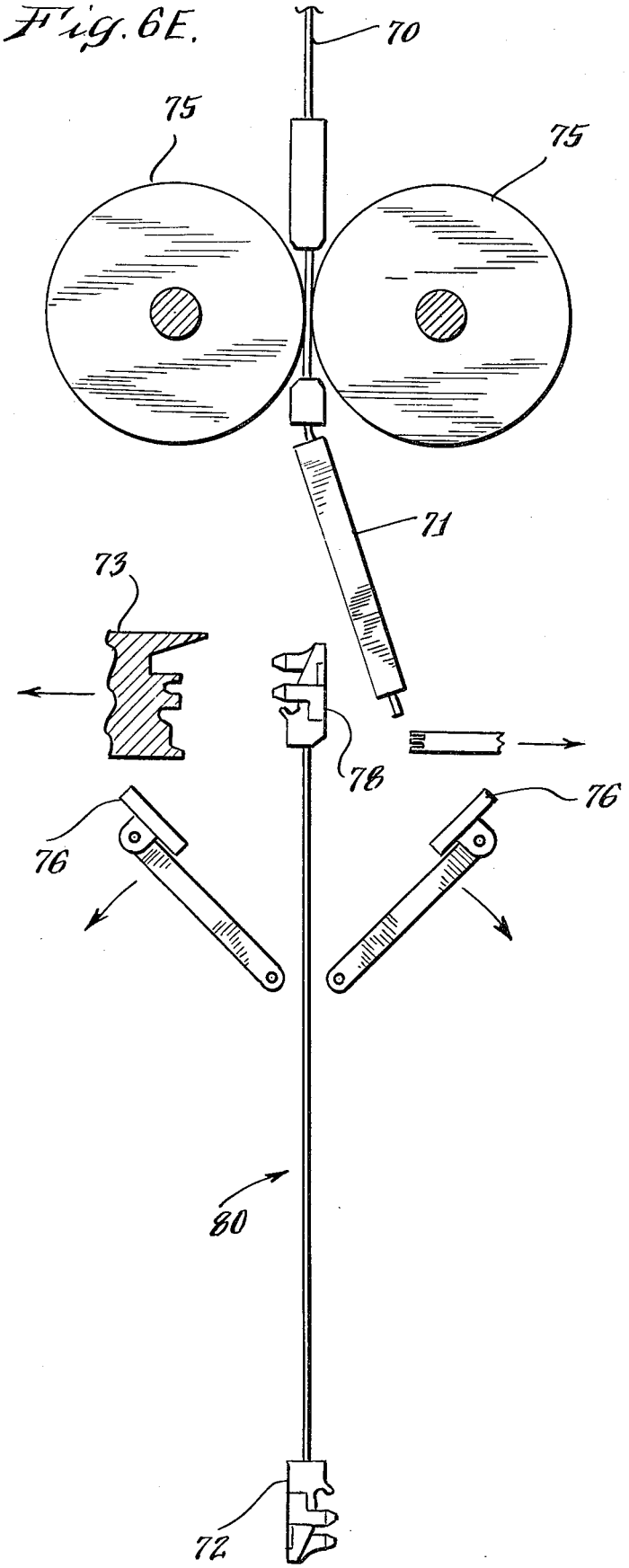

FIGS. 4A and 4B shows in detail the two parts of an assembly tool 50, in both an open (FIG. 4A) and closed (FIG. 4B) position, which is secured to movable carriage assembly 19 and used to place an electrical connector on both the leading and trailing ends of the electrical lead that is being manufactured.Specifically, there is shown an assembly tool comprising a first portion 51 that includes a connector nest area 52 into which a connector is placed either by an operator or automatically, and which connector is secured in place within nest area 52 by connector finger clamps 53. A cam mechanism 54 is provided to allow finger clamps 53 to open. There is also illustrated an ejector mechanism 55 activated by a driving pin (pins 44 and 47 of FIG. 3) in the manner as described hereinabove, an ejector release key 56, and an ejector return spring 57 which enables the ejector mechanism to return to an open position after the driving pins have withdrawn from the assembly tool. The second part 58 of assembly tool 50 includes a plurality of wire inserters 59 which allow for the proper positioning of the wires within the assembly tool so that the wires can be secured within an electrical connector when assembly tool 50 is activated and closed, as illustrated in FIG. 4B, FIG. 5 shows in detail a locking mechanism 60 which can be used for locking the movable carriage assembly in position during and until a particular operation is completed, i.e. cutting of the wires by the cutting tools or attachments of the leading or trailing end connector to the wires by the assembly tools. The power air cylinder 41 illustrated in FIG. 3 is connected by suitable mechanical linkage to a pressure switch (not shown). As air cylinder 41 is being pressurized, which occurs when either the cutting operation or the operation involving the attachment of either of the connectors are completed, at some pre-determined pressure, a pressure switch (not shown) is activated and this in turn electrically energizes solenoid 61 which then pulls in on piston 62. This causes lock 63 to pivot about pin 64 and remove itself from any of the lock openings (not shown) that are located at each station within frame member 30 where there is a cutting tool or assembly tool. As the movable carriage assembly is motor driven to its next position, the pressure air cylinder 41 is reduced to a point such that when the next operational position is reached, lock 63 pivots and again locks the carriage assembly in place.

Referring now to FIGS. 6A through 6E there is illustrated the salient process steps that are involved during the operation of an electrical wire lead making apparatus in accordance with the features of the invention. At the start position for the manufacture of an electrical wire lead (See FIG. 6A) wires 70 (substantially parallel wires are located behind the wire shown in the drawings) extend beyond the exit of pivotable wire guide 71 a sufficient distance to allow for securing a leading electrical connector 72 thereto. With the movable carriage assembly locked in place such that assembly tool 73 with preloaded leading electrical connector 72 being thereby properly positioned at the work location 74 a switch is activated either by an operator or automatically which activates a power air cylinder in the manner as described hereinabove to cause assembly tool 73 to move inward, secure leading connector 72 to wires 70, and then retract. Thereafter, (see FIG. 6B) by either the press of a button by an operator or by an automatic mode, feed rollers 75 feed a preset length of wires 70 down through the machine. The feeding of a preset amount of wire is accomplished by inputting the required length of wire desired into an electronic controller, e.g. a Superior Electric Preset Indexer—Model #SP 155A-1230, and having the controller control the operation of a drive motor, e.g. a Superior Electric SLO-SXN Stepping Motor, Model #M112-FJ326 which in turn drives rollers 75 and controls the length of the wires fed by these rollers. When feed rollers 75 are activated (note—the movable carriage assembly is still in a locked position), and after about $1\frac{1}{2}$ inches of wire have been fed, the jaws of split wire guide gripper 76 partially close to form a guide through which the wires can be guided and remain straight during the wire feeding operation. It is important to keep the wires straight so that the wires are in a proper position for cutting, and also so they do not cross over each other and bend. The purpose of initially feeding about $1\frac{1}{2}$ inches of wire prior to allowing the jaws of gripper 76 to close is to allow leading connector 72 to clear the area where the jaws close. The wires are then fed by rollers 75 to the required length. Thereafter, the movable carriage assembly is unlocked, transports the cutting tool (cutting blades) 77 to the work location 74, and is then locked into position (see FIG. 6C). At this time during the operation, the two assembly tools which hold the leading and trailing connectors are loaded with connectors by an operator or automatically. With the jaws of gripper 76 now completely closing on wires 70 to secure the wires in place, cutting blades 77 move in, cut the wires and retract. With gripper 76 still completely closed on wires 70, the movable carriage assembly unlocks, transports the assembly tool having trailing connector 78 therein to work location 74, and locks into position (see FIG. 6D). During this time, pivoting wire guide 71 pivots out of the work location as shown to allow trailing connector 78 to be brought into position at the work location, and be secured to wires 70 as the wires are firmly gripped by the jaws of gripper 76. A camming device (not shown) activated by the position of the movable carriage assembly, pivots pivoting wire guide 71 into and out of its position within the work location. The trailing connector is then secured to the wires. At this point, electrical wire lead 80 is complete, and the jaws of gripper 76 fully open (see FIG. 6E) to permit the completed lead to fall away from the machine into a collection bin where the completed leads are stored. The opening and closing of the jaws of gripper 76 is controlled by an air cylinder (not shown) that is actuated by a microswitch that is in turn actuated by the movable carriage assembly. At this time, the movable carriage assembly unlocks, moves the assembly tool carrying a leading connector 72 to work location 74 and locks into position (see FIG. 6A), and pivoting wire guide 71 pivots back to its original position.

The apparatus of this invention has been described above with regard to an operator initiating several of the operations, and also with regard to the machine operating automatically. In the totally automatic mode, the apparatus in accordance with the present invention would operate in timed sequence during the repetitive cycles of operation as described above. It is to be understood that coordination of all the operations of the apparatus in the totally automatic mode would be carried out in sequence by suitable drive mechanisms and control means for such drive mechanisms. Such drive mechanisms and control means are of conventional known construction, and their use in the apparatus of this invention for the totally automatic mode would be well within the knowledge of one having ordinary skill in the art, and therefore, are not disclosed herein.

While this invention has been described in conjunction with a specific embodiment thereof, it is evident that many alternatives, modifications and variations will be apparent to those skilled in the art. Accordingly, the present invention is intended to embrace all such alternatives, modifications and variations and fall within the spirit and scope of the appended claims.

What is claimed is:

1. A method for manufacturing an electrical wire lead comprising the steps of:

securing a first electrical connector to the leading end portion of at least one electrical wire at a work location which the leading end portion is being held by displaceable guide means;

feeding a pre-determined length of said wire axially in a given direction, said guide means guiding said wire as it is being fed;

gripping a portion of said wire;

cutting said wire at said work location;

displacing the guide means by pivoting it away from said work location before securing a second electrical connector to the trailing end portion of said wire; and securing a second electrical connector to the trailing end portion of said wire at said work location.

2. An apparatus for withdrawing a pre-determined length of electrical wire from a supply, severing said pre-determined length from said supply, and installing an electrical connector on at least one end of said length, comprising:

feed means mounted on support means for advancing a pre-determined length of wire axially in a given direction;

guide means mounted on said support means having an entry for receiving wire from said feed means, and an exit for positioning wire at a work location;

gripper means mounted on said support means and spaced from the exit of said guide means along the given direction of motion of a wire, for gripping a portion of wire which has exited from said guide means;

cutter means positioned on connector carrying means and movable along a path transverse to said direction of motion of a wire intermediate said exit of said guide means and said gripper means for severing a wire which has exited from said guide means;

said connector carrying means movably mounted on said support means and movable along a path transverse to said given direction of motion of a wire, said path being positioned intermediate said exit of said guide means and said gripper means, for advancing a connector into position for an attachment to a wire which has exited from said guide means;

said guide means being movable mounted relative the path of said connector carrying means so that the exit of said guide means may be selectively and pivotably displaced away from the path of said connector carrying means to permit carrying a connector into position for attachment to a wire gripped in said gripper means; and release means mounted on said connector carrying means for separating a severed, pre-determined length of wire from said gripper means.

3. An apparatus according to claim 1 wherein said feed means comprises a pair of cooperating feed rollers.

4. An apparatus according to claim 3 wherein the length of wire fed by said rollers is controlled by a pre-set control mechanism.

5. An apparatus according to claim 1 wherein said gripper means comprises a pair of cooperating jaws with a plurality of finger-like elements that provide a series of openings to allow for wire to pass when the jaws are in a partially closed position.

6. An apparatus according to claim 1 wherein said connector carrying means has positioned thereon said cutter means, a first assembly tool for attaching a connector to the leading end of said wire, and a second assembly tool for attaching a connector to the trailing end of said wire.

7. An apparatus according to claim 1 further comprising locking means mounted on said connector carrying means for securing different regions of said connector carrying means along said path of travel thereof at said work location.

8. An apparatus according to claim 7 wherein said connector carrying means includes said cutter means positioned in a first region thereof, a first assembly tool for attaching a connector to the leading end of said wire positioned in a second region of said carrying means, and a second assembly tool for attaching a connector to the trailing end of said wire positioned in a third region of said carrying means.

9. An apparatus according to claim 1 wherein said feed means advances a pre-determined length of a plurality of discrete electrical wires axially in a given direction.

10. An apparatus according to claim 1 wherein said feed means advances a pre-determined length of a plurality of electrical wires in side-by-side relation axially in a given direction.

11. An apparatus according to claim 1 wherein said feed means advances a pre-determined length of a plurality of electrical wires joined together in side-by-side relation axially in a given direction.

* * * * *